United States Patent [19]

Bell et al.

[11] 4,401,229

[45] Aug. 30, 1983

[54] CARTON TRAY AND LID WITH MEMBRANE SEALING-HINGING ARRANGEMENT

[75] Inventors: Richard L. Bell, Exton; Charles R. Helms, Malvern, both of Pa.

[73] Assignee: Container Corporation of America, Chicago, Ill.

[21] Appl. No.: 361,597

[22] Filed: Mar. 25, 1982

[51] Int. Cl.[3] ..... B65D 43/16; B65D 43/18; B65D 51/18

[52] U.S. Cl. ..... 220/259; 220/258; 220/339; 229/43

[58] Field of Search ..... 220/256, 257, 258, 259, 220/339, 359; 229/43

[56] References Cited

U.S. PATENT DOCUMENTS

| | | | |
|---|---|---|---|
| 3,893,566 | 7/1975 | Ross | 229/43 |
| 4,040,561 | 8/1977 | Philippon | 220/259 |
| 4,328,905 | 5/1982 | Hardt | 220/258 |
| 4,359,169 | 11/1982 | Helms et al. | 220/258 |

*Primary Examiner*—George T. Hall

*Attorney, Agent, or Firm*—Richard W. Carpenter; Davis Chin

[57] ABSTRACT

A carton including separate tray and cover members and a membrane interposed therebetween which serves both a sealing and hinging function.

8 Claims, 8 Drawing Figures

CARTON TRAY AND LID WITH MEMBRANE SEALING-HINGING ARRANGEMENT

BACKGROUND OF THE INVENTION

1. Field of the Invention

This invention relates to cartons and more particularly to a carton and lid arrangement which includes a membrane interposed therebetween and serving both as a sealing barrier and a hinge mechanism.

2. Description of the Prior Art

A prior art search directed to the subject matter of this application in the United States Patent and Trademark Office disclosed in the following U.S. Pat. Nos.: 2,858,224; 3,082,903; 3,117,703; 3,202,272; 3,282,477; 3,605,374; 3,765,595; 3,854,618; 3,862,703; 3,976,196; 4,143,165.

None of the prior art patents uncovered in the search disclosed the concept of a carton having separate tray and lid members which have no direct connection with each other at any time expect through a sealable membrane which serves both as a barrier and hinge means between the members.

SUMMARY OF THE INVENTION

This invention relates generally to cartons and more particularly to paperboard, plastic, or combination cartons of the type having tray and lid members requiring a hermetic seal therebetween.

It is a particular object of the invention to provide, in a carton of the type described, a membrane-type closure arrangement wherein the membrane not only serves to effect a hermetic seal between the tray and lid members of the carton but also is capable of functioning as a hinge means between the two members.

This and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
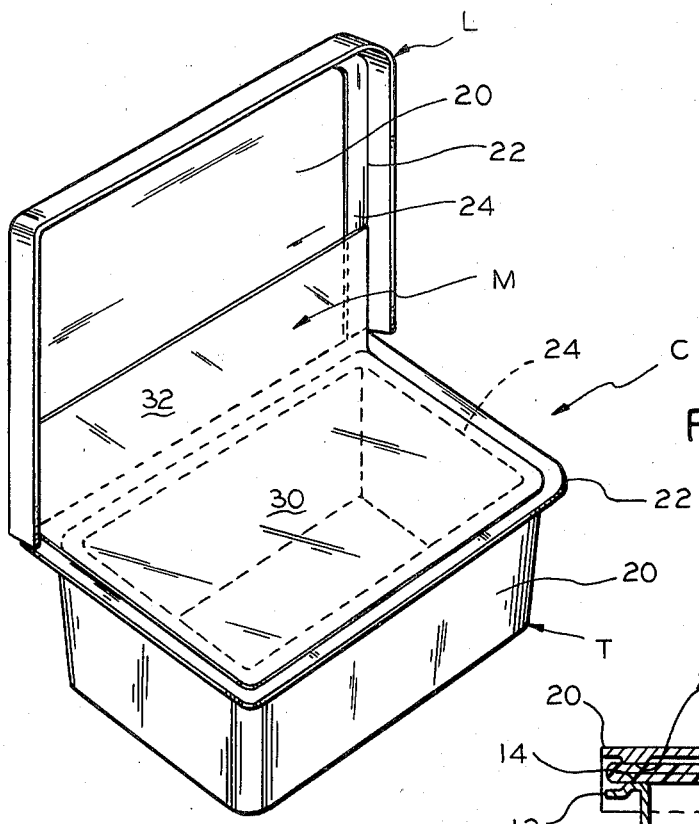
FIG. 1 is a perspective view of a carton embodying the novel sealing-hinging arrangement of the invention, as shown with lid in open position.
Figure 3:
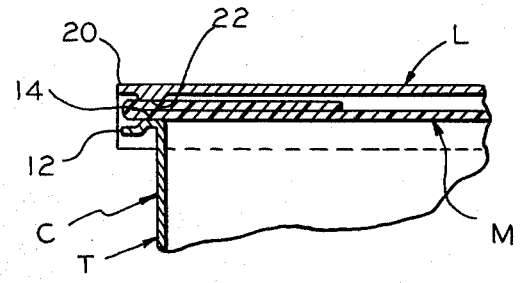
FIG. 3 is a fragmentary sectional view of a portion of the structure illustrated in FIG. 1, but with the lid shown in the closed position.
Figure 2:
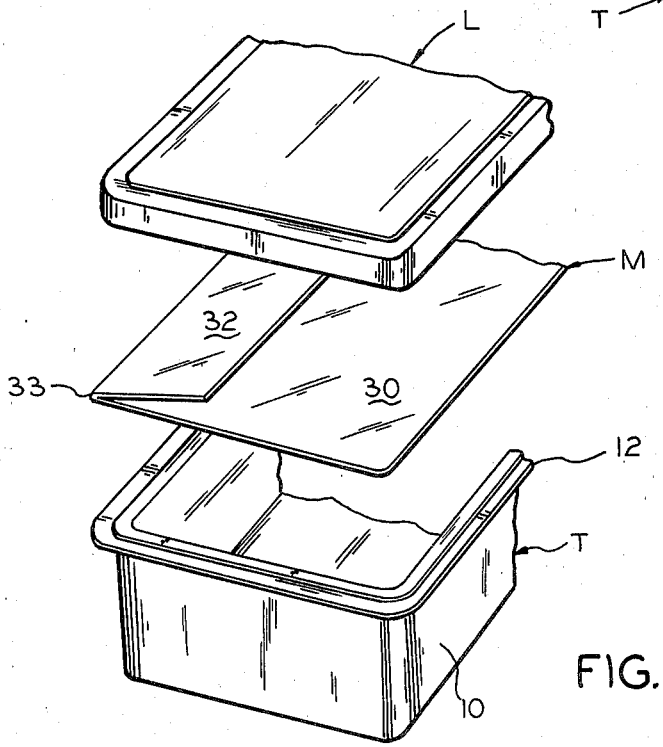
FIG. 2 is an exploded perspective view of the structure illustrated in FIG. 1 with the lid shown in what would be the closed position were this not an exploded view.

Referring now to the drawings for a better understanding of the invention and particularly to FIGS. 1, 2 and 3, it will be seen that the carton, indicated generally at C in these views, includes separate tray and lid members, indicated generally T and L, respectively, and a relatively thin flexible, sealable member, indicated generally at M, which is interposed between the tray and lid members of the carton to serve as both a barrier and a hinging mechanism therebetween As best seen in FIGS. 1 and 2 tray T includes a body portion 10 having at its upper end an annular, integral rim 12, which presents an upwardly facing, flat sealing surface 14.

Lid L includes a top wall panel 20 and a peripheral rim 22, which in turn presents a downwardly facing, flat, sealing surface 24.

In order to provide a hermetic seal between the tray and lid members of the carton, there is provided a membrane indicated generally at M. The membrane is a relatively thin flat flexible article preferably formed of a metallic material such as foil so as to be capable of bonding by induction sealing. It is possible however that the membrane may be formed of some other material which is capable of being heat sealed or attached in some other related manner.

As best seen in FIG. 2 membrane M is divided into larger and smaller sections 30 and 32, respectively, by a fold line 33, with the sections being folded over one atop the other.

After the carton has been filled, the membrane is interposed between the tray and cover with the membrane being sealed to the sealing surfaces of the respective members.

Still referring to FIGS. 1 and 2, it will be seen that one portion 30 of the membrane is substantially larger than the other portion 32. Portion 30 is large enough to cover the entire sealing surface 14 of the tray; whereas smaller portion 32 is only large enough to cover at least one side of the sealing surface 24 of the lid. It is only necessary that one complete surface be covered by the membrane. The only reason for covering a portion of the sealing surface of the other by the other section of the membrane is for attachment thereto to provide a hinge means between the two members.

Thus, it will be appreciated that after the carton has been sealed, when it is desired to open the carton the, lid may be raised and the membrane may either be peeled away from three sides of the sealing surface of the tray, to provide access to the contents of the tray and yet leave the membrane still attached to the tray, so that it can function as a hinge upon reclosure of the carton.

Although it is contemplated that the membrane be bonded in peelable arrangement, it is still possible to have a non-peelable membrane wherein a portion of the membrane is cut away to provide access to the carton tray and at the same time leave other portions of the membrane attached for hinging purposes.

Figure 5:
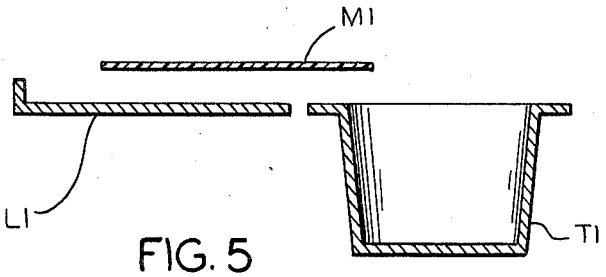
FIGS. 4, 5, and 6 are fragmentary sectional views similar to the views of FIGS. 1, 2 and 3, respectively, but illustrate a slightly modified form of the invention.
Figure 6:
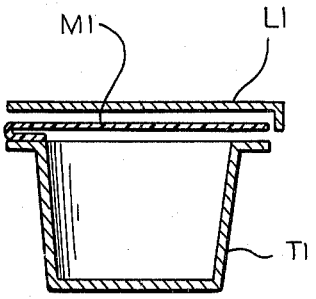
Figure 4:
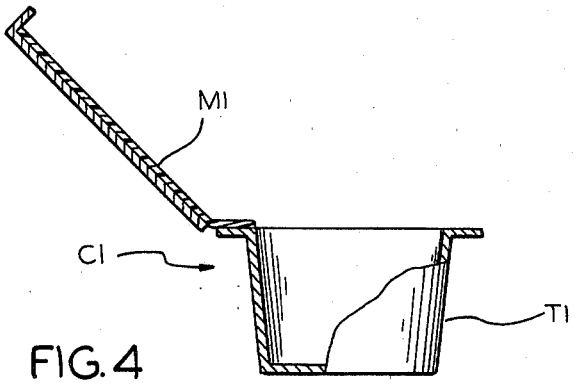

Turning now to FIGS. 4, 5 and 6 of the drawings, it will be seen that a comparable arrangement is shown. The carton in these views indicated generally at C1 includes a tray indicated generally at T1, a lid indicated generally at L1 and a membrane indicated generally at M1. The individual portions of the structure are comparable to those of the previous views so specific numerals have not been used to designate them.

The primary difference between this arrangement and that illustrated FIGS. 1 through 3 is that the larger portion of the membrane is attached to the lid and the smaller portion to the cover. In other words it is a mere reversal of the arrangement illustrated in FIG. 1.

Figure 7:
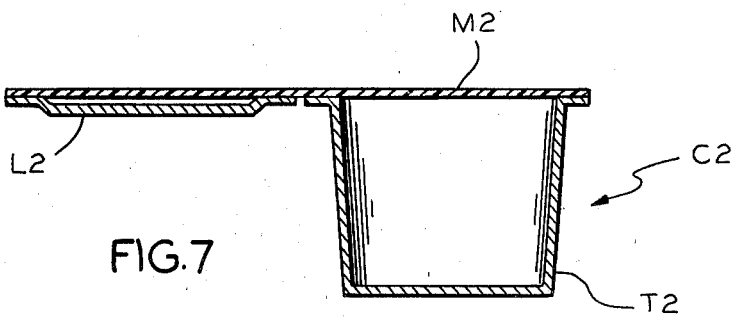
FIGS. 7 and 8 are views similar to FIGS. 4 and 6, respectively, but illustrate yet another form of the invention.
Figure 8:
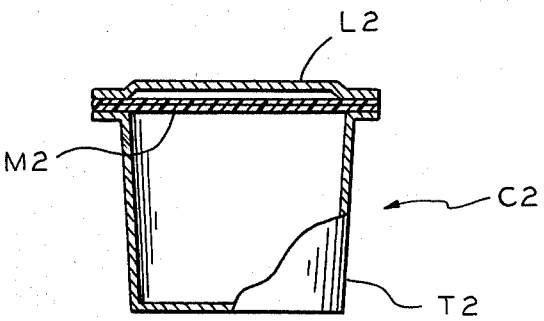

Turning now to FIGS. 7 and 8, yet another modification of the invention is shown. In this case carton C2 includes Tray T2, a Lid L2, and membrane M2.

Again the primary difference in this embodiment is that both portions of the membrane are large enough to cover the entire sealing surfaces of the tray and lid members, but the membrane functions in exactly the same manner as that of the previous use.

What is claimed is:

1. In a sealing-hinging arrangement for a carton, the combination of:

(a) a body member including a rim presenting a sealing surface;

(b) a separate lid member including a rim presenting a sealing surface;

(c) a relatively thin, flexible, membrane formed of a sealable material and folded upon itself to present two sections separated from each other by a fold line;

(d) one of said sections being of sufficient size and shape to cover the entire sealing surface of the rim of one of said members, and the other of said sections being of sufficient size and shape to cover at least a portion of the sealing surface of the rim of the other member at one side of said other member;

(e) said sections being sealed to the rim sealing surfaces of the respective members to effect a hermetic seal therebetween;

(f) said members being free from direct connection to each other, with said membrane functioning as the sole connection and hinge means between said members.

2. An arrangement according to claim 1, wherein said sealing surfaces are flat and raised from the surrounding portions of the respective members.

3. An arrangement according to claim 1, wherein said membrane is formed of a metallic material that is adapted for induction sealing.

4. An arrangement according to claim 1, wherein said membrane is peelably sealed to said sealing surfaces.

5. An arrangement according to claim 1, wherein said membrane sections are each large enough to cover the entire sealing surfaces of their respective members.

6. An arrangement according to claim 1, wherein one of said membrane sections can be peeled off of all but a portion of its related sealing surface so that the membrane can still function as a hinge after the carton has been initially opened.

7. An arrangement according to claim 1, wherein the membrane is sealed in a folded position with the closure on the container.

8. An arrangement according to claim 1, wherein the membrane is sealed in an unfolded position with the closure alongside the container.

* * * * *